US007798354B2

(12) United States Patent
Stowers, Sr.

(10) Patent No.: US 7,798,354 B2
(45) Date of Patent: Sep. 21, 2010

(54) EATING RECEPTACLE FRAME THAT INCORPORATES A PLATE AND CUP ASSEMBLY

(76) Inventor: Duane B. Stowers, Sr., 31031 24$^{th}$ Ct. S., Federal Way, WA (US) 98003

( * ) Notice: Subject to any disclaimer, the term of this patent is extended or adjusted under 35 U.S.C. 154(b) by 454 days.

(21) Appl. No.: 11/599,846

(22) Filed: Nov. 6, 2006

(65) Prior Publication Data

US 2008/0105690 A1 May 8, 2008

(51) Int. Cl.
*B65D 21/02* (2006.01)
*B65D 1/34* (2006.01)
*B65D 6/04* (2006.01)

(52) U.S. Cl. ..... 220/23.8; 220/737; 206/562

(58) Field of Classification Search ..... 220/23.8, 220/575, 755; 224/217, 218, 270; 206/562; D7/550.1, 552.1, 553.1, 553.5
See application file for complete search history.

(56) References Cited

U.S. PATENT DOCUMENTS 3,955,672 A * 5/1976 Brundage ..... 206/562
5,110,170 A * 5/1992 Boatwright ..... 294/146
5,152,398 A * 10/1992 Forestal et al. ..... 206/561
D331,860 S * 12/1992 Stanfield ..... D7/549
5,301,871 A * 4/1994 Gross et al. ..... 206/562
5,323,910 A * 6/1994 van de Graaf, Jr. ..... 206/557
5,390,798 A * 2/1995 Yanuzzi ..... 206/562
5,678,694 A * 10/1997 Tanaka et al. ..... 206/561
5,695,052 A * 12/1997 Damato ..... 206/217
5,697,512 A * 12/1997 Brickley ..... 220/23.8
5,947,011 A * 9/1999 Xu ..... 99/357
6,422,453 B1 * 7/2002 Wang ..... 229/114
6,672,622 B2 * 1/2004 Barron ..... 281/44
7,284,675 B2 * 10/2007 Chang ..... 220/574

* cited by examiner

*Primary Examiner*—Anthony Stashick
*Assistant Examiner*—Madison L Wright
(74) *Attorney, Agent, or Firm*—Blakely Sokoloff Taylor & Zafman, LLP

(57) ABSTRACT

An eating receptacle frame that incorporates a plate and cup assembly which can accept large or small diameter cup sizes into the inserted cup hole. The receptacle plate and cup assembly also incorporates a middle finger hole for balance of the receptacle plate and cup assembly. The cup hole diameter can be increased by detaching a perforated section of the cup holder's outer hole diameter for a larger size cup and parallel dotted lines that can be cut out to enable stemmed glasses to be held. (2) A reusable frame with overlapping tongues or any supporting device that will hold a disposable plate. The molded plate cup assembly has a flexible hole reducer that will attach to the rim of the cup holder decreasing the diameter for the insertion of a smaller cup.

12 Claims, 2 Drawing Sheets

EATING RECEPTACLE FRAME THAT INCORPORATES A PLATE AND CUP ASSEMBLY

BACKGROUND OF THE INVENTION

Field

The subject invention is in the field of disposable and re-usable receptacle plate and cup assemblies which is designed to allow the user to use one hand and forearm for holding a disposable or re-usable plate and cup assembly. The forearm along with a middle finger which is inserted into the finger hole of the receptacle plate and cup assembly helps to balance the receptacle plate and cup assembly while having the other hand free to eat or drink. U.S. Pat. No. 3,955,672 has some similarity related to using the forearm for support, but when the user wants to drink from the cup support member the user has to release the cup with the support hand to remove the cup with the free hand thereby losing some of the support and balance of the body. The cup support member takes up some of the food area of the plate. U.S. Pat. No. 4,461,396 has a thumb and hand support, which after a period of time the hand, could get tired. The thumb support of the patent design decreases the food area as well. This looks more like an appetizer plate and glass holder.

SUMMARY

The subject invention is a receptacle plate and cup assembly in which a disposable plate can be used on a disposable receptacle frame. The re-usable plate can be molded into the receptacle plate and cup assembly making it an all in one assembly. These receptacle plate and cup holders will enable the user to balance the frame assembly using the forearm and a middle finger which is inserted into the finger hole and having one hand free to eat or drink. The disposable receptacle plate and cup assembly can accept most disposable plate forms made by a variety of plate manufacturers.

After installing the disposable plate on the rim of the disposable receptacle plate and cup assembly, those skilled in the art would logically make the receptacle plate and cup assembly an all in one assembly, molding the plate into the receptacle frame, that can be used as a disposable receptacle plate and cup assembly or a reusable receptacle plate and cup assembly, using products such as paper, wood, plastic, bamboo, metal, glass, stoneware and Corelle ware. The receptacle plate and cup assembly can have sectional areas on the plate. The subject invention is great for just about any event where you have to stand or sit without a table.

Figure 1:
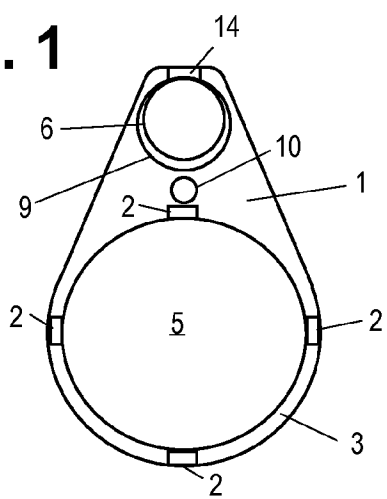

FIG. 1 Disposable receptacle plate and cup assembly with a perforated section of the outer hole for the cup.

Figure 2:
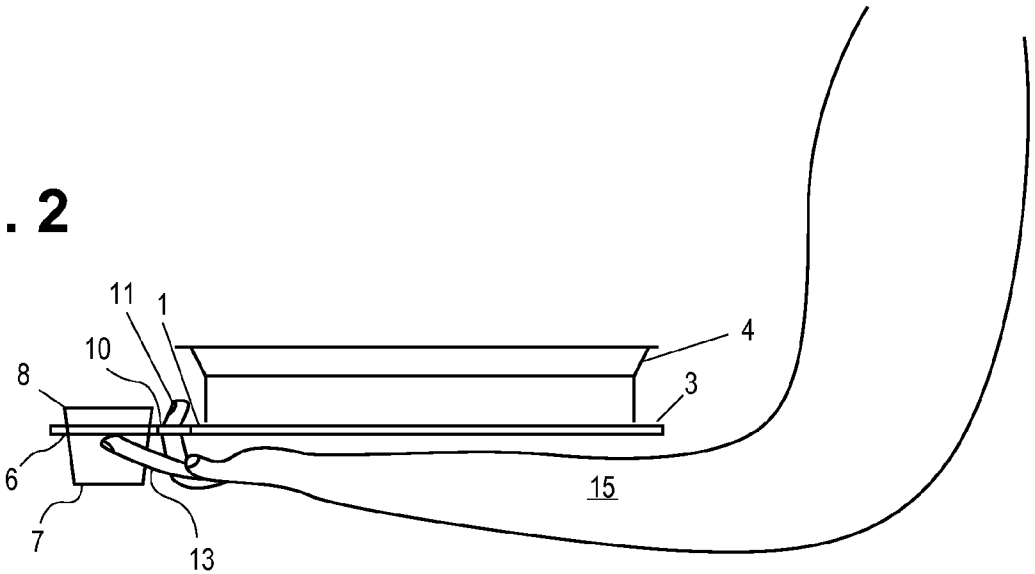

FIG. 2 Side view of the disposable receptacle plate and cup assembly.

Figure 3:
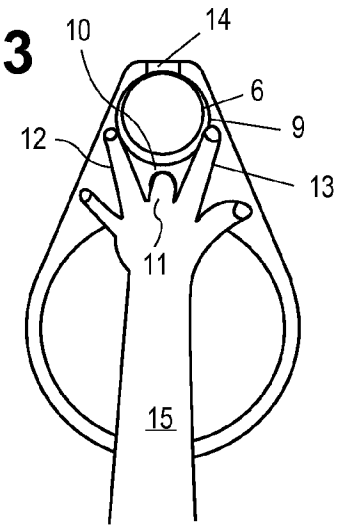

FIG. 3 Bottom view showing the hand positioning of finger on the disposable receptacle plate and cup assembly.

Figure 4:
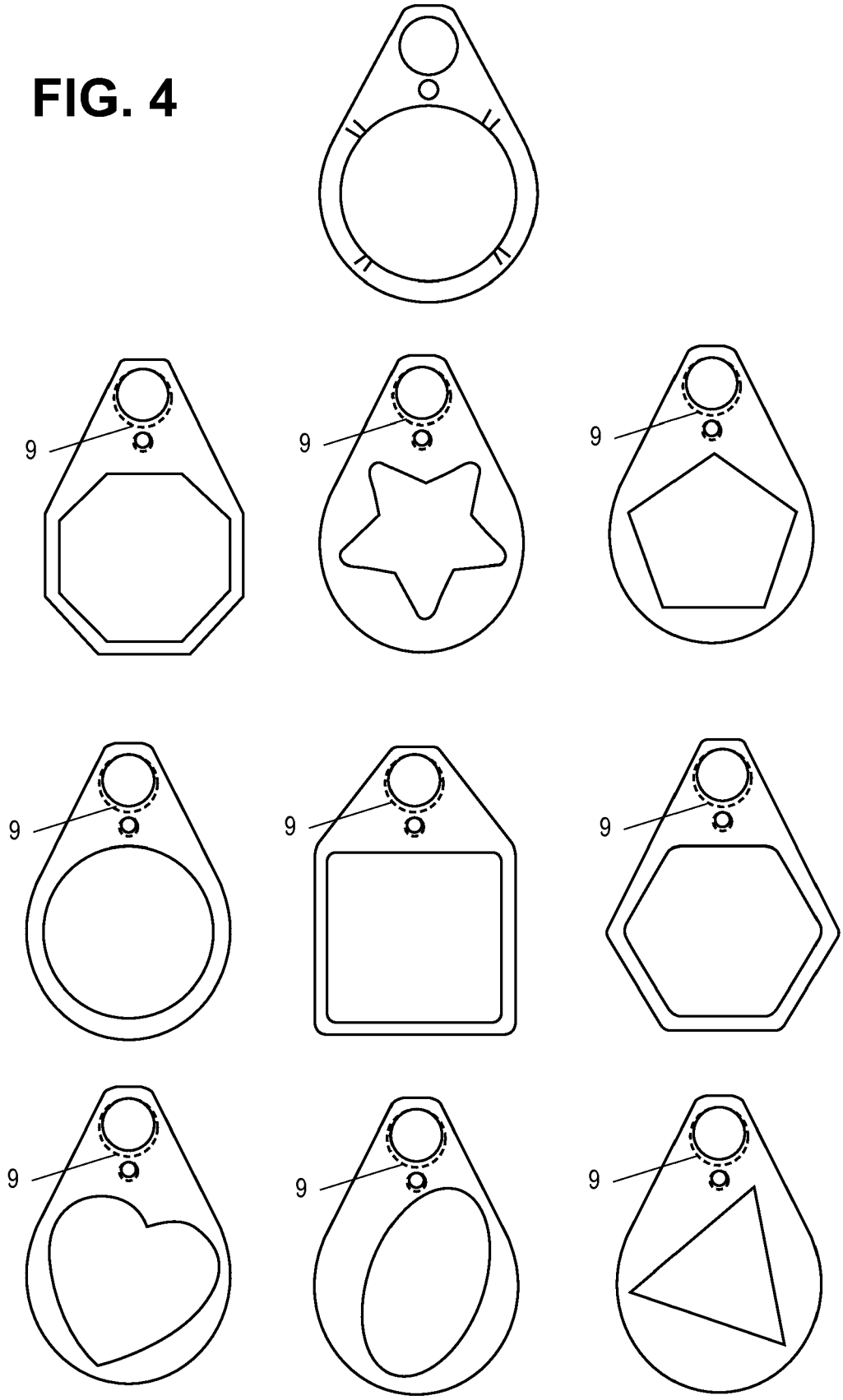

FIG. 4 Top view of all the receptacle frames and plate shapes circle, triangle, square, pentagon, hexagon octagon, oval, star and heart shaped plates.

DETAILED DESCRIPTION OF THE INVENTION

An eating receptacle frame that incorporates a plate and cup assembly which can accept large or small diameter cup sizes into the inserted cup hole. The receptacle plate and cup assembly also incorporates a middle finger hole for balance of the receptacle plate and cup assembly. The receptacle plate and cup assembly is of (3) designs, 8 different shapes with a variety of different size plates or bowls. (1) a disposable plate and cup assembly which is made of corrugated card board, Styrofoam or plastic that will hold a disposable plate and cup. The cup hole diameter can be increased by detaching a perforated section of the cup holder's outer hole diameter for a larger size cup and parallel dotted lines that can be cut out to enable stemmed glasses to be held. (2) A reusable frame with overlapping tongues or any supporting device that will hold a disposable plate. This frame can be made out of plastic, wood, or light metals. (3) Those skilled in the art would logically make the receptacle plate and cup assembly an all, in one assembly, molding the plate into the receptacle frame, the receptacle frame can be used as a disposable receptacle plate and cup assembly or a reusable receptacle plate and cup assembly. The receptacle frame can be constructed of plastic, glass, metal, wood products, bamboo, Corelle Ware or stoneware which has a molded plate built into the receptacle plate and cup assembly for re-usable plates. The molded plate cup assembly has a flexible hole reducer that will attach to the rim of the cup holder decreasing the diameter for the insertion of a smaller cup.

FIG. 1 Is a disposable receptacle plate and cup assembly 1 that has double backed adhesive tape 2 mounted on the rim 3 of the receptacle plate and cup assembly 1. The tape is applied in four places on the receptacle frame 1. The paper is removed from the double backed adhesive tape 2 and FIG. 2 the bottom of the disposable plate 4 is then applied and secured to the receptacle plate cup assembly 1. FIG. 1 The food area of the plate 5 can be of one food area or have sectional food areas. The disposable receptacle plate and cup assembly 1 also has cup holder 6 which FIG. 2 a cup 7 is inserted into the cup holder 6 having the brim 8 of the cup 7 extending 1"-1½" above the frame 1. This will allow the hand to pick up the cup 7. FIG. 1 A perforated section 9 can be detached from the cup holder opening 6 for a larger diameter cup. FIG. 3 The designs will have a finger hole 10 for the insertion of a middle finger 11 into the receptacle plate and cup assembly 1. The ring finger 12 on one side of the cup holder 6 along with the index finger 13 on the other side of the cup holder 6 both fingers 12 and 13 will extend out and on both sides of the cup 6 and under the disposable receptacle plate and cup assembly 1, this will give added support to the cup holder 6. The cup holder 6 will also have parallel dotted lines that can be cut out to form a channel 14, enabling a stemmed glass to be held. FIG. 2, the receptacle plate and cup assembly 1 with the plate 4 installed and positioned on the forearm 15 contributing even more support and balance for the user.

I claim:

1. A method, comprising:

inserting a first finger from a bottom surface, through a finger hole, to a top surface of a plate and cup assembly;

resting a second finger on the bottom surface of the plate and cup assembly underneath a cup holder included in the plate and cup assembly;

resting a third finger on the bottom surface of the plate and cup assembly underneath the cup holder;

installing a cup into the cup holder such that a first portion of the cup extends above the top surface of the plate and cup assembly and a second portion of the cup extends beneath the bottom surface of the plate and cup assembly, wherein the second and third fingers are on opposite sides of the cup to give added support to the cup holder; and balancing the plate and cup assembly with a forearm and the first finger while a thumb remains below the bottom surface of the plate and cup assembly.

2. The method of claim 1, wherein the first finger is a middle finger.

3. A plate and cup assembly, comprising:

means for receiving a first finger from a bottom surface, through a finger hole, to a top surface of the plate and cup assembly;

means for resting a second finger on the bottom surface of the plate and cup assembly underneath a cup holder included in the plate and cup assembly;

means for resting a third finger on the bottom surface of the plate and cup assembly underneath the cup holder;

means for receiving a cup into the cup holder such that a first portion of the cup extends above the top surface of the plate and cup assembly and a second portion of the cup extends beneath the bottom surface of the plate and cup assembly, wherein the second and third fingers are on opposite sides of the cup to give added support to the cup holder; and means for balancing the plate and cup assembly with a forearm and the first finger while a thumb remains below the bottom surface of the plate and cup assembly.

4. The plate and cup assembly of claim 3, wherein the first finger is a middle finger.

5. The plate and cup assembly of claim 3, wherein the means for receiving a cup includes a cup portion, wherein the cup portion is configured to receive a section that is detachable such that if the detachable section is disposed in the cup portion, a diameter of the cup portion is smaller than the diameter of the cup portion when the detachable section is removed from the cup portion.

6. The plate and cup assembly of claim 3, wherein the means for receiving a cup includes a cup holding area, wherein the cup holding area includes a section configured to be detached from the cup holding area to permit the cup holding area to accommodate the insertion of a larger cup.

7. The plate and cup assembly of claim 3 further comprising a plate portion having a rim configured to receive a plate.

8. The plate and cup assembly of claim 7, wherein a hole in the plate portion is configured to receive a plate having a shape of at least one of a triangle, square, pentagon, hexagon, octagon, oval, star and heart shaped plates.

9. The plate and cup assembly of claim 7, further comprising adhesive tape mounted on the rim for securing the plate to the plate and cup assembly.

10. The plate and cup assembly of claim 3, further comprising a plate portion having a food bearing surface.

11. The plate and cup assembly of claim 10, wherein the cup holder, the finger hole and the food bearing surface of the plate portion are disposed collinearly with the finger hole disposed between the cup holder and the food bearing surface of the plate portion.

12. The plate and cup assembly of claim 3, further comprising a channel with parallel lines at a cup opening, the parallel lines configured to be cut out for the insertion of plastic or glass stem ware.

* * * * *